US005967760A

United States Patent [19]

Howie et al.

[11] Patent Number: 5,967,760

[45] Date of Patent: Oct. 19, 1999

[54] JET PUMP WITH FILTER FOR WASHING MACHINES

[75] Inventors: David M. Howie, Waukesha, Wis.; Kenyon A. Hapke, Libertyville, Ill.; David Koth, East Troy, Wis.

[73] Assignee: U.S. Controls Corporation, New Berlin, Wis.

[21] Appl. No.: 08/971,483

[22] Filed: Nov. 14, 1997

[51] Int. Cl.[6] ..... F04B 23/08

[52] U.S. Cl. ..... 417/80; 417/79; 417/160

[58] Field of Search ..... 417/79, 80, 160

[56] References Cited

U.S. PATENT DOCUMENTS 2,677,389 5/1954 Jisha et al. ..... 137/565

3,158,101 11/1964 Dollar ..... 103/5

3,807,419 4/1974 Cushing et al. ..... 134/104

5,133,324 7/1992 Michiaki ..... 123/514

*Primary Examiner*—Charles G. Freay

*Assistant Examiner*—Ehud G Artenberg

*Attorney, Agent, or Firm*—Quarles & Brady

[57] ABSTRACT

A clog resistant pump for washwater employs two water flow circuits. The first powered by a conventional motor-driven pump uses filtered washwater and drives a jet-pump discharging unfiltered washwater from the washing machine. The intake or discharged water from the jet-pump is used to operate a self-cleaning filter providing water for the first circuit of the motor-driven pump. The position of the filter in the stream of wastewater and adjustment of the filter apertures in size and area reduce clogging yet allow sufficiently filtered water to permit a conventional high efficiency motor-driven pump to be used in the first stage.

14 Claims, 2 Drawing Sheets

FIG. 4
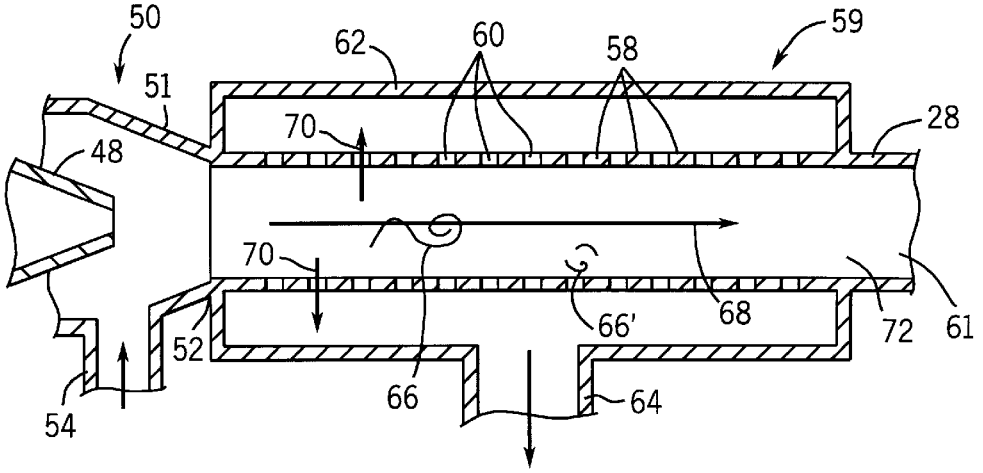
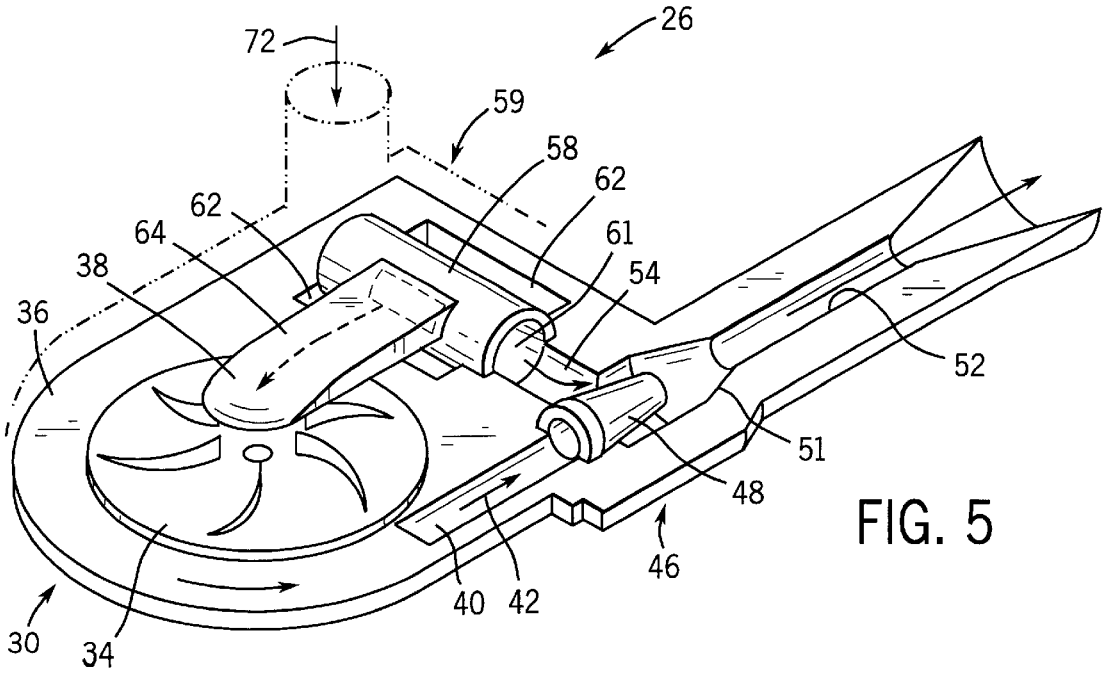
FIG. 5

JET PUMP WITH FILTER FOR WASHING MACHINES

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to pumps for discharging water from washing machines or the like and, in particular, to a high efficiency pump resistant to clogging from waste-water debris.

Clothes washing machines employ a pump for draining washwater from a washtub after completion of a washing cycle. The washwater typically includes suspended dirt and lint from the wash, as coarsely filtered through holes in a spin basket held within the washtub. The washwater may also include larger items, such as buttons or coins, and small articles of clothing, such as handkerchiefs and shoelaces, which may find their way around the edge of the spin basket into the washtub or even through the relatively large holes in the spin basket. Such debris in the washwater may clog the pump used to drain the washtub.

A screen placed directly between the pump and the washtub to protect the pump would be expected to clog frequently from an accumulation of lint. Accordingly, the coarse filtering of the spin basket alone is relied upon and the clearance of the pump impeller and housing is increased so as to reduce the chance that a hard and compact item such as a button will become jammed between these moving surfaces. The increased clearance between the impeller and housing lowers the efficiency of the pump thereby increasing the cost of operation. Further, even high clearance pumps are susceptible to fouling by items such as shoelaces or strings which can wrap about the impeller despite the increased clearance.

The problem of pump clogging can be more acute in high water conserving washing machines where smaller pumps and lower amounts of water are used.

The need exists, therefore, for a high efficiency washwater pump resistant to clogging from washwater debris.

BRIEF SUMMARY OF THE INVENTION

The present invention provides a clog resistant high efficiency pump using dual water circulation circuits. In the first circuit, a low clearance motor driven pump, such as an impeller pump, receives filtered washwater and pumps it to power a jet pump, circulating water in the second circuit. The jet pump has no moving parts and therefore is resistant to clogging or fouling from washwater debris and thus accepts unfiltered washwater. The filtered washwater for the motor pump is obtained from a filter assembly positioned so that pumped water passes over the filter surface. The design of the filter assembly and its location in a high velocity stream of wastewater prevents clogging of the filter.

Specifically, the present invention provides a washwater pump having a motor pump unit with an inlet and outlet. The motor pump unit operates to pump washwater from the inlet to the outlet. A jet pump having a jet inlet is connected to the outlet. The jet inlet communicates with a jet nozzle directed across a jet pump chamber having an inlet and an outlet into a venturi zone. The jet pump operates to pump washwater from the inlet to the outlet under the influence of a jet of water from the jet nozzle.

A filter assembly has a filter assembly inlet directing the washwater across a filter element toward a filter assembly outlet. A filter element has a surface with apertures allowing passage of a portion of the washwater through the apertures to a filtered water outlet connected to the inlet.

Thus, it is one object of the invention to permit a clog resistant jet pump to be used in a water conserving washing machine by operating the jet pump solely with filtered washwater rather than with an external source of clean water. By using a two circuit pumping system, filtered washwater may be used to power the jet pump.

The filter assembly outlet may be connected to the jet pump inlet and the filter assembly inlet may receive water directly from the washing machine or the like.

Thus it is another object of the invention to achieve a high flow rate with good energy efficiency by placing the filter ahead of the jet pump. For a given size jet pump, greater throughput is realized than will be obtained if the filter is placed after the jet pump.

The filter element may be sintered material such as a sintered plastic.

It is another object of the invention therefore to provide a filter element that has small individual apertures yet extremely large total aperture area so as to reduce radial force on washwater debris such as would promote clogging.

The apertures of the filter may be positioned to allow passage of the washwater in a direction substantially perpendicular to the flow of water between the filter assembly inlet and filter assembly outlet. The filter assembly inlet may direct the stream of washwater adjacent to the surface of the filter element.

Thus, it is another object of the invention to use the discharged water from the jet pump to clean the filter used to provide filtered water to the motor pump for the jet pump, thus avoiding clogging.

The apertures of the filter may be sized so that the velocity of washwater passing through the apertures is substantially less than the velocity of water passing across the apertures between the filter assembly inlet and filter assembly outlet. The number of apertures may be selected so that a pressure difference across the filter will not hold washwater debris against the filter.

Thus, it is another object of the invention to adjust the flow rates through the apertures of the filter to reduce the accumulation and retention of debris against the apertures such as might promote clogging.

The apertures in the surface of the filter element may be sized to be smaller than the clearance of the components of the motor pump.

Thus, it is another object of the invention to permit a high efficiency impeller-type pump to be used in this application. Because only a portion of the water being pumped from the washing machine needs to pass through the first stage through the motor pump, and because of the self-cleaning aspects of the filter assembly, small apertures may be used to filter the water to the motor pump allowing a low clearance high efficiency pump to be used.

The surface of the filter element may form a tube connecting the filter assembly inlet and the filter assembly outlet, and the cross section of the filter surface perpendicular to the axis between the filter assembly inlet and the filter assembly outlet, may be substantially equal to an area of opening of the filter assembly inlet and the filter assembly outlet.

Thus, it is another object of the invention to provide a filter assembly that reduces stagnant water such as could permit a settling out of debris against the surfaces of the filter.

The foregoing and other objects and advantages of the invention will appear from the following description. In this description, reference is made to the accompanying drawings, which form a part hereof, and in which there is shown by way of illustration a preferred embodiment of the invention. Such embodiment does not necessarily represent the full scope of the invention, however, and reference must be made therefore to the claims for interpreting the scope of the invention.

BRIEF DESCRIPTION OF THE SEVERAL VIEWS OF THE DRAWINGS

FIG. 4 is a simplified cross-sectional view of the jet pump and filter element of FIG. 3, showing relative forces and velocities of water flows acting on washwater debris; and FIG. 5 is a perspective view of an integral pump assembly in partial cutaway showing placement of a filter ahead of the jet pump so as to improve efficiency and throughput.

DETAILED DESCRIPTION OF THE INVENTION

Figure 1:
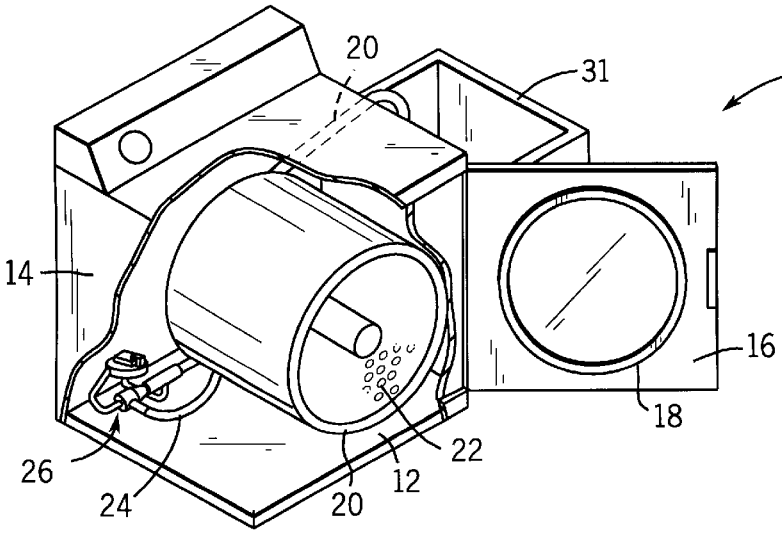
FIG. 1 is a perspective view of a water conserving washing machine in cut-away showing the washwater pump of the present invention positioned to receive water from a horizontally oriented washtub for discharge into an adjacent sink unit.

Referring now to FIG. 1, a water conserving washing machine 10 includes a generally cylindrical washtub 20 positioned within a housing 14. A spin basket 12 is positioned concentrically within the washtub 20 and may rotate freely therein to agitate and spin-dry contained clothing (not shown).

The axis of the washtub and spin basket 12 may be tipped from horizontal slightly upward toward the front of the housing 14 so that the spin basket 12 may receive clothes through a door 16. The door 16 includes a gasket 18 sealing against a lip of the washtub 20 to provide a sealed enclosure around the spin basket 12 holding in washwater.

The spin basket 12 includes a plurality of radially extending holes 22 allowing water introduced within the spin basket 12 to communicate with the washtub 20 and to drain therefrom at the end of the wash cycle through a drain hose 24. The water from drain hose 24 is pumped by pump assembly 26 through discharge hose 28 to an accompanying wash basin 31 or the like.

Figure 2:
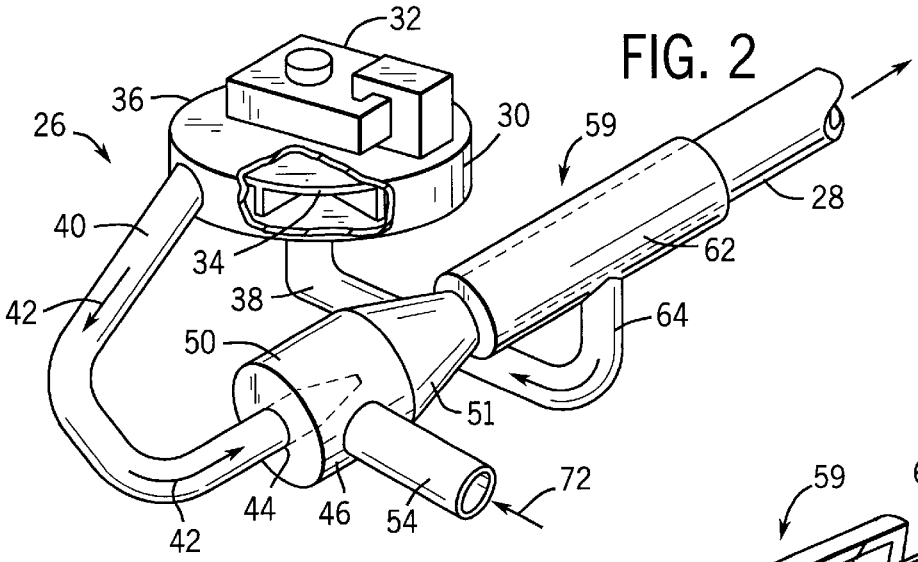
FIG. 2 is a perspective view of the wastewater pump of FIG. 1 in greater detail showing the two water circulation circuits of a motor pump and jet pump respectively, and showing the positioning of a filter element around the venturi of the jet pump for extracting filtered water for the motor pump.

Referring now to FIG. 2, the pump assembly 26 incorporates two water flow circuits. The first circuit includes a motor-pump 30 having a motor 32 rotating an impeller 34 contained within a housing. The impeller 34 receives water at its center from an inlet pipe 38 and drives it centrifugally outward along tangentially exiting outlet 40 as indicated by arrow 42. Motor pump 30 may alternatively make use of the main motor (not shown) of the washing machine 10 instead of a separate motor 32.

The motor-pump 30 may have low clearances between impeller 34 and pump housing 36 to provide for the greatest possible pumping efficiency. As will be described, the motor-pump 30 operates on filtered water so low clearances are possible without clogging. Such pumps 30 are well-known to those of ordinary skill in the art.

Figure 3:
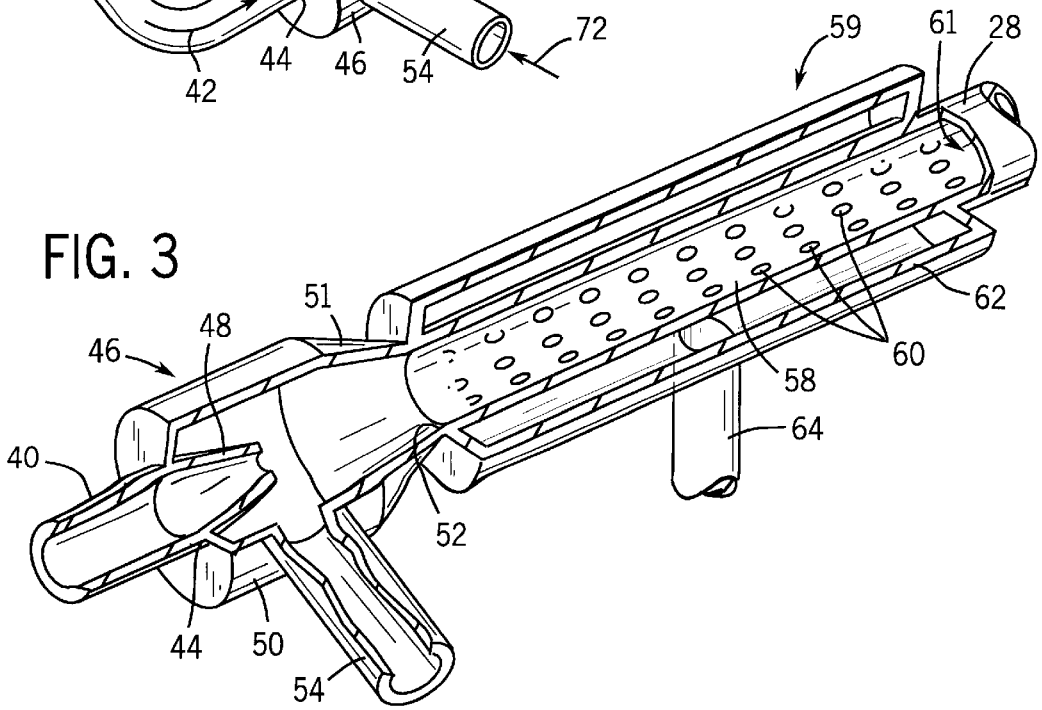
FIG. 3 is a perspective cross-sectional view of the jet pump and filter element of FIG. 2, showing the path of water from the jet pump across the filter surface of the filter element.

Referring to FIGS. 2 and 3, the pump outlet 40 is connected to a jet inlet 44 of a jet pump 46 to provide water to a nozzle 48 located at one base of a cylindrical jet pump chamber 50. Nozzle 48 directs water along an axis of the chamber 50 toward an outlet 52 positioned opposite the nozzle 48 in the path of water exiting nozzle 48. Outlet 52 is formed at the apex of a funnel-shaped end wall 51 attached to the other base of the chamber 50 opening toward nozzle 48 to catch and collect water therefrom.

As will be understood to those of ordinary skill in the art, high velocity water exiting nozzle 48 through outlet 52 will draw along with it excess water contained within the chamber 50 thus providing jet pumping action. The jet pump 46 is highly resistant to clogging because it has no moving parts which could capture washwater debris or constrictions which could block the flow of such debris. As will be understood to those of ordinary skill in the art, the relationship of nozzle and venturi in diameters, transition zones and spacing of the same maybe optimized to achieve mass flow ratios much greater than 1:1 thus using a small amount of water at high pressure to move a large amount of water at a lower pressure.

Referring still to FIGS. 2 and 3, during operation of the jet pump 46, an inlet 54 to the chamber 50 receives water from drain hose 24 from the washtub 20 (shown in FIG. 1) which then is pumped through outlet 52. The water from inlet 54 and the water from the nozzle 48 combined to flow through outlet 52 into a tubular filter surface 58 having filter apertures 60 radially oriented through its outer surface. Apertures 60 are sized to be smaller than the clearance of the motor-pump 30 so as to prevent clogging of the motor-pump 30.

Surrounding the filter surface 58 is a filtered water chamber 62 collecting filtered water passing through the apertures 60. The filtered water is collected by filtered water outlet 64 connecting the filtered water chamber 62 to the inlet pipe 38 of motor-pump 30.

Most of the water entering the filter 59 passes all the way through the tubular filter surface 58 to the filter outlet 61 where it is conducted to the discharge hose 28. This water is discharged from the washing machine 10. A small portion of the water entering the filter 59 passes through apertures 60 and proceeds through filtered water outlet 64 to return via an inlet pipe 38 to the motor-pump 30.

This small portion of the water is the water of the first circuit of the pump, which includes motor-pump 30, pump outlet 40, jet pump 46, filter 59 and inlet pipe 38. The second circuit of the pump carries the larger portion of the washwater and includes drain hose 24, jet pump 46, filter 59 and discharge hose 28.

Referring now to FIG. 4, washwater debris 66 passing through tubular filter surface 58 is acted on by the relatively greater force 68 of water exhausted from nozzle 48 and by the relatively lesser force 70 of water passing from the center of tubular filter surface 58 through the apertures 60. The apertures 60 are dispersed over the filter surface 58 and are of sufficient number and area to ensure that force 70 is substantially less than the force 68 given the relative water flow in the two circuits. The tubular structure of filter surface 58 discourages both stagnant water or areas of turbulence which could affect this relative force balance. As a result, debris 66 is swept past apertures 60 preventing the filter surface 58 from becoming clogged. The filter 59 need not be placed in the constriction immediately following the jet pump 46 but may alternatively be placed at a later, wider portion of a discharge tube.

The velocity of water exiting the nozzle 48 is maintained sufficiently high as to prevent a settling out of debris but to maintain the debris generally in suspension.

Debris 66' which contacts an aperture 60, thus potentially blocking flow, is not held in that position because the pressure drop across each aperture 60 is low in comparison to the force 68. This is guaranteed by ensuring that there is sufficient total aperture area among the apertures 60 and low enough flow so that the pressure drop across a clogged aperture 60 (and hence on debris 66') remains extremely low compared to the force 68 exerted by the flowing water.

Referring now to FIG. 5, in a second embodiment, the pump filter 59 is placed upstream of the jet pump 46 so that the filter outlet 61 connects directly to the jet pump inlet 54. The inlet to the filter 59 therefore receives washwater directly from the washing machine and diverts part of the washwater through the filtered water outlet 64 to the impeller 34 of the motor pump 30. Water from the motor pump 30 proceeds to the pump outlet 40 as indicated by arrow 42 into the nozzle 48 of the jet pump 46 where it draws water through the jet pump inlet 54 to discharge it out the jet pump outlet 52 forming part of a venturi. In this embodiment, a smaller jet pump 46 may be used for a given flow volume because none of the water output by the jet pump 46 is retracted for use by a motor pump 30 as is the case in the embodiments of FIGS. 2, 3 and 4. The velocity of the water through the filter element 58 may be made comparable to the water discharged from the jet pump 46 without placing the filter 59 downstream from the jet pump 46. The result is an ability to use a smaller and more efficient jet pump 46 for a desired water flow.

The filter element 58 may have apertures 60 cut or molded through it by mechanical means or in the preferred embodiment may be a sintered polymer material having numerous apertures 60 irregularly distributed as gaps between sintered polymer beads. Such materials are commercially available from Porex Technologies in Atlanta, Ga. Such sintered materials may be formed into a hollow tube or tubular form of other cross-sections such as hexagons or squares as may be desired.

The above description has been that of a preferred embodiment of the present invention. It will occur to those that practice the art that many modifications may be made without departing from the spirit and scope of the invention. For example, the motor pump may include other pump designs well-known in the art other than impeller pumps. Clearly washing machines other than water conserving horizontal axis washing machines can also make use of this pump to improve efficiency and to reduce clogging. In order to apprise the public of the various embodiments that may fall within the scope of the invention, the following claims are made.

We claim:

1. A washwater pump comprising:

a motor-driven pump unit having a motor-driven pump inlet and motor-driven pump outlet, the motor-driven pump unit operating to pump washwater from the motor-driven pump inlet to the motor-driven pump outlet;

a jet-pump unit having a jet inlet connected to the motor-driven pump outlet, the jet inlet communicating with a jet nozzle directed across a chamber having a jet-pump inlet and a jet-pump outlet, the jet-pump operating to pump washwater from the jet-pump inlet to the jet-pump outlet under the influence of a jet of water from the jet nozzle; and a filter assembly having a filter assembly inlet directing pumped water across a filter element toward a filter assembly outlet, the filter element having a surface with apertures allowing passage of a portion of the washwater through the apertures to a filtered water outlet connected to the motor-driven pump inlet.

2. The washwater pump of claim 1 wherein the filter assembly inlet is connected to the jet-pump outlet.

3. The washwater pump of claim 1 wherein the filter assembly outlet is connected to the jet-pump inlet.

4. The washwater pump of claim 1 wherein the apertures allow passage of washwater in a direction substantially perpendicular to a flow of water between the filter assembly inlet and filter assembly outlet.

5. The washwater pump of claim 1 wherein the filter assembly inlet directs a stream of washwater against the surface of the filter element.

6. The washwater pump of claim 1 wherein the apertures are sized so that the velocity of washwater passing through the apertures is substantially less than the velocity of water passing across the apertures between the filter assembly inlet and filter assembly outlet.

7. The washwater pump of claim 1 wherein the number of apertures is selected so that a pressure difference across the filter will not hold washwater debris against the filter.

8. The washwater pump of claim 1 wherein the motor-driven pump is an impeller pump.

9. The washwater pump of claim 8 having a clearance between an impeller and a housing and wherein the apertures in the surface of the filter element are sized to be smaller than the clearance.

10. The washwater pump of claim 1 wherein the surface of the filter element forms a tube connecting the filter assembly inlet and filter assembly outlet.

11. The washwater pump of claim 1 wherein the filter is a sintered material.

12. The washwater pump of claim 1 wherein the filter is a sintered polymer material.

13. The washwater pump of claim 10 wherein a cross section of the filter surface perpendicular to an axis between the filter assembly inlet and filter assembly outlet is substantially equal to an area of opening of the filter assembly inlet and filter assembly outlet.

14. The washwater pump of claim 1 wherein the filter assembly inlet and filter assembly outlet define between them a filter chamber incorporating the surface of the filter and wherein the filter chamber is sized to provide a velocity of water flow past the surface of the filter to suspend washwater debris.

* * * * *